US006619345B2

(12) United States Patent
Havumaki et al.

(10) Patent No.: US 6,619,345 B2
(45) Date of Patent: Sep. 16, 2003

(54) ARRANGEMENT FOR A DEBARKING SHAFT

(75) Inventors: Jouni Havumaki, Vaaksy (FI); Pekka Kokko, Hollola (FI); Bruce Kirkpatrick, Lachine (CA)

(73) Assignee: Andritz Oy, Hollola (FI)

( * ) Notice: Subject to any disclaimer, the term of this patent is extended or adjusted under 35 U.S.C. 154(b) by 0 days.

(21) Appl. No.: 10/120,619

(22) Filed: Apr. 11, 2002

(65) Prior Publication Data

US 2002/0170624 A1 Nov. 21, 2002

Related U.S. Application Data

(60) Provisional application No. 60/283,908, filed on Apr. 13, 2001.

(51) Int. Cl.[7] ..... B27L 1/00

(52) U.S. Cl. ..... 144/208.9; 144/208.4; 144/341; 241/236; 483/32

(58) Field of Search ..... 241/236, 238; 483/32; 144/208.1, 208.4, 208.6, 208.9, 340, 341

(56) References Cited

U.S. PATENT DOCUMENTS

| | | | | |
|---|---|---|---|---|
| 3,228,440 A | | 1/1966 | Ferrabee | 144/208 |
| 4,842,029 A | * | 6/1989 | De Abreu | 144/117.1 |
| 5,094,281 A | | 3/1992 | Barnhill et al. | 144/208 J |
| 5,394,912 A | * | 3/1995 | Hume | 144/208.1 |
| 5,630,453 A | | 5/1997 | Ishizawa | 144/208.9 |
| 6,189,583 B1 | * | 2/2001 | Kokko et al. | 144/208.1 |

FOREIGN PATENT DOCUMENTS

FI 852752 1/1986

OTHER PUBLICATIONS

International Search Report corresponding to International Application No. PCT/FI02/00122 dated Jun. 27, 2002.
English Abstract of DE3524837, Feb. 1986.
Search Report from Finland.

* cited by examiner

*Primary Examiner*—W. Donald Bray
(74) *Attorney, Agent, or Firm*—Alix, Yale & Ristas, LLP

(57) ABSTRACT

The invention relates to a debarking shaft arrangement for a debarking machine (1). A number of rotatable debarking shafts (3) extending parallel to the advancing direction of the logs (2) are provided with a number of teeth (4) extending beyond the circumferential surface of the shaft (3) and adapted to strip bark off the logs transversely to the lengthwise direction of the logs. The teeth (4) are designed to be effective in both rotating directions of said rotatable debarking shafts (3), and the debarking shafts (3) are designed to be reversibly mounted in the debarking machine. Reversible debarking shafts equipped with bi-directionally effective teeth permit renewal of worn teeth on a debarking shaft by reversing the orientation of the shaft relative to the debarking machine.

14 Claims, 3 Drawing Sheets

ARRANGEMENT FOR A DEBARKING SHAFT

CROSS REFERENCE TO RELATED APPLICATION

This application claims the benefit of U.S. Provisional Application No. 60/283,908, filed Apr. 13, 2001.

BACKGROUND OF THE INVENTION

1. Field of the Invention

The invention relates to a debarking shaft arrangement for a debarking machine, and more particularly to a debarking machine in which the debarking shafts are configured to permit reversible installation and use.

2. Description of the Related Art

Debarking machines for debarking logs typically employ a number of rotating debarking shafts provided with a number of teeth extending beyond the circumferential surface of the shaft. The teeth are adapted to strip bark off the logs transversely to the length of the logs and at the same to convey the trees transversely relative to the shafts. The shafts constitute at least a part of a support surface, upon which the logs travel through the debarking machine. Related debarking machines are described in U.S. Pat. Nos. 4,685,498 and 5,394,912.

A problem with the above type of prior known debarking machines is the inconvenience and high cost of repairing worn or damaged teeth. The teeth must be repaired one at a time while the debarking shaft remains stationary in the debarking machine.

SUMMARY OF THE INVENTION

To eliminate this drawback, a debarking machine in accordance with the present invention incorporates a debarking shaft system in which the debarking teeth associated with each shaft are designed to be effective in opposite rotating directions of the debarking shafts. Further, the debarking shafts are designed to be reversible. The inventive debarking machine enables a speedy deployment of new teeth just by removing and securing a shaft at 180° relative to the original position (reversed), whereby it is parallel to the original position but has an opposite rotating direction with respect to the original position.

Debarking teeth in accordance with the present invention have two working faces arranged to be effective in opposite rotational directions of the shaft to which they are mounted. The teeth on each working face can be different from or similar to each other. When using dissimilar teeth in the opposite rotating directions of a shaft, a different debarking capacity will be obtained in various rotating directions, e.g. for wintertime barking and summertime barking. It is also possible to use sharp teeth first for the debarking of hard-to-bark or frozen trees, and to use worn teeth for the treatment of easy-to-bark trees.

In one preferred embodiment of the invention, the arrangement is such that the debarking shaft is designed and dimensioned such that a dislodged shaft, after being pivoted through 180°, is mountable in the same position or in a corresponding position. This arrangement is relevant primarily when the debarking machine is provided with two types of shafts that are compatible in terms of the mounting and symmetrical in terms of the axial pitch of teeth mounted thereto. In this preferred embodiment, every other shaft position is always provided with an identical shaft. The above expression "a corresponding position" should be understood to indicate a shaft position compatible with the mounting and axial positioning of teeth mounted to the shaft as is further discussed below.

In particularly preferred embodiments of the invention, the arrangement is such that the debarking shaft is designed and dimensioned in such a way that a dislodged shaft, after being pivoted through 180°, is mountable in the position of an adjacent shaft or in a corresponding position. The expression "a corresponding position" refers to those alternating positions for a debarking shaft in which the shafts lie co-directionally. This arrangement is applicable when all debarking shafts in a debarking machine are identical to each other. This arrangement offers the advantage that the debarking machine only requires a single type of spare shaft that is hence fit for all positions. In principle, such a shaft could be secured in the same position in each of its pivoted positions, but this would require e.g. different attachment points for different shaft pivoting directions.

In yet another preferred embodiment of the invention, attachment of a debarking shaft to a debarking machine is implemented in such a way that, in the process of dislodging, the shaft is liftable from its position and, respectively, in the process of installation, settable into its position from above the debarking mechanism.

BRIEF DESCRIPTION OF THE DRAWINGS

The invention will now be described in more detail with reference to the accompanying drawings, in which.

DETAILED DESCRIPTION OF THE PREFERRED EMBODIMENT

Figure 2:
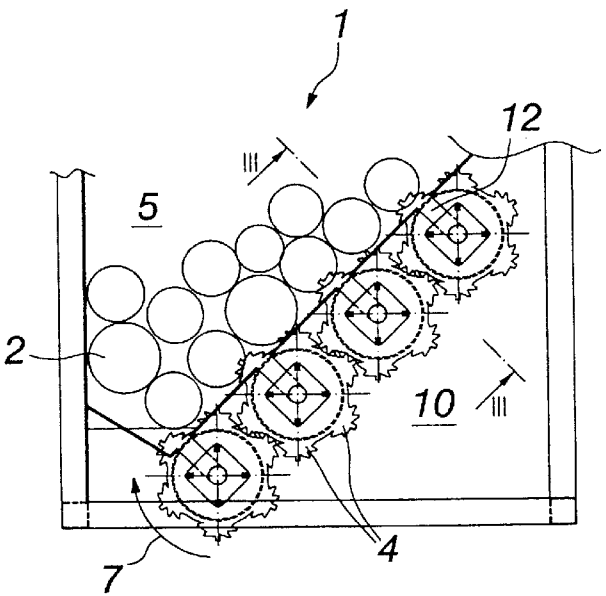
FIG. 2 is a sectional view of the debarking machine of FIG. 1, taken along line II—II thereof.

A debarking machine 1 depicted in the drawings is intended for the preliminary debarking (decortication) of trees (logs) 2 prior to a separately performed final barking and for the expulsion of at least some of the removed barks from a wood flow passing through the debarking machine.

The debarking machine 1 is provided with a number of rotatable debarking shafts 3 extending parallel to the advancing direction of the logs 2 to be fed therethrough. In the illustrated example, the debarking shafts 3 have each end thereof provided with sprockets 6, whereby, at least at one end of the debarking machine 1, the sprockets 6 are by way of a sprocket chain (not shown) connected to each other and to the gear of an electric motor, not shown. The debarking shafts 3 are provided with a number of teeth 4 extending beyond the circumferential surface of the shaft 3 and adapted to strip bark off the logs 2 transversely to the longitudinal direction of the logs and at same time to convey the trees transversely relative to the debarking shafts 3.

The debarking shafts 3, together with the teeth 4 thereof, constitute a part of a support surface for carrying the trees 2 through the debarking machine 1. The illustrated example includes four debarking shafts 3 which are assembled relative to each other to define an inclined plane. Other than that, the support surfaces comprise solid surfaces which are designed for providing, together with the support surface constituted by the debarking shafts, an open-ended chute extending the length of the debarking machine 1. The chute can be open-topped or covered.

Figure 1:
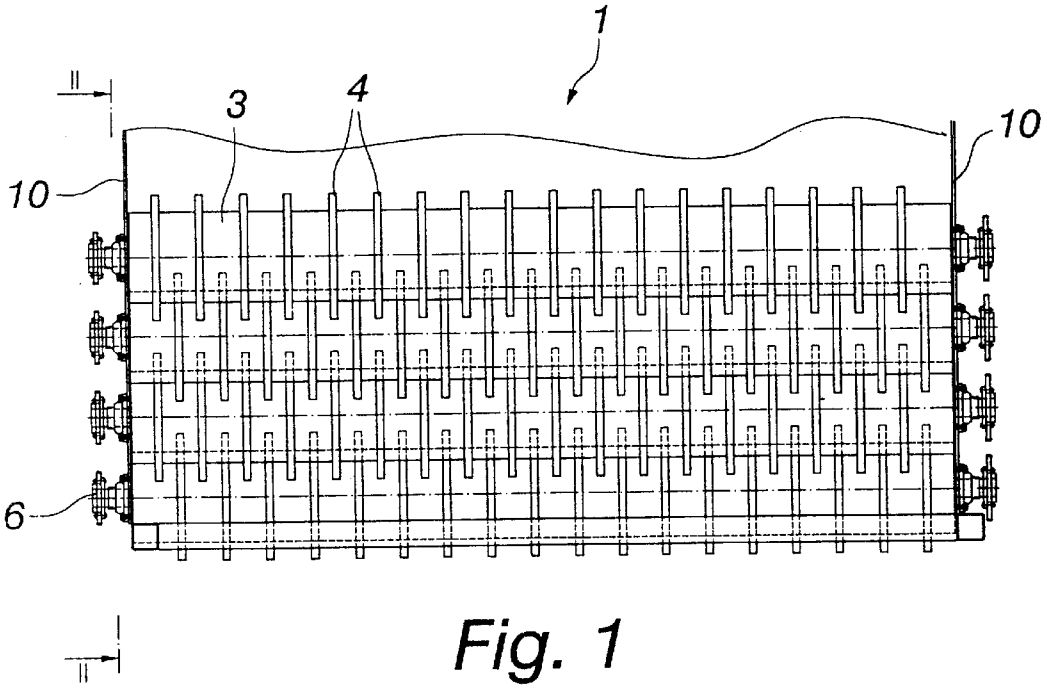
FIG. 1 is a schematic side view of debarking shafts mounted a debarking machine in accordance with the present invention.
Figure 3:
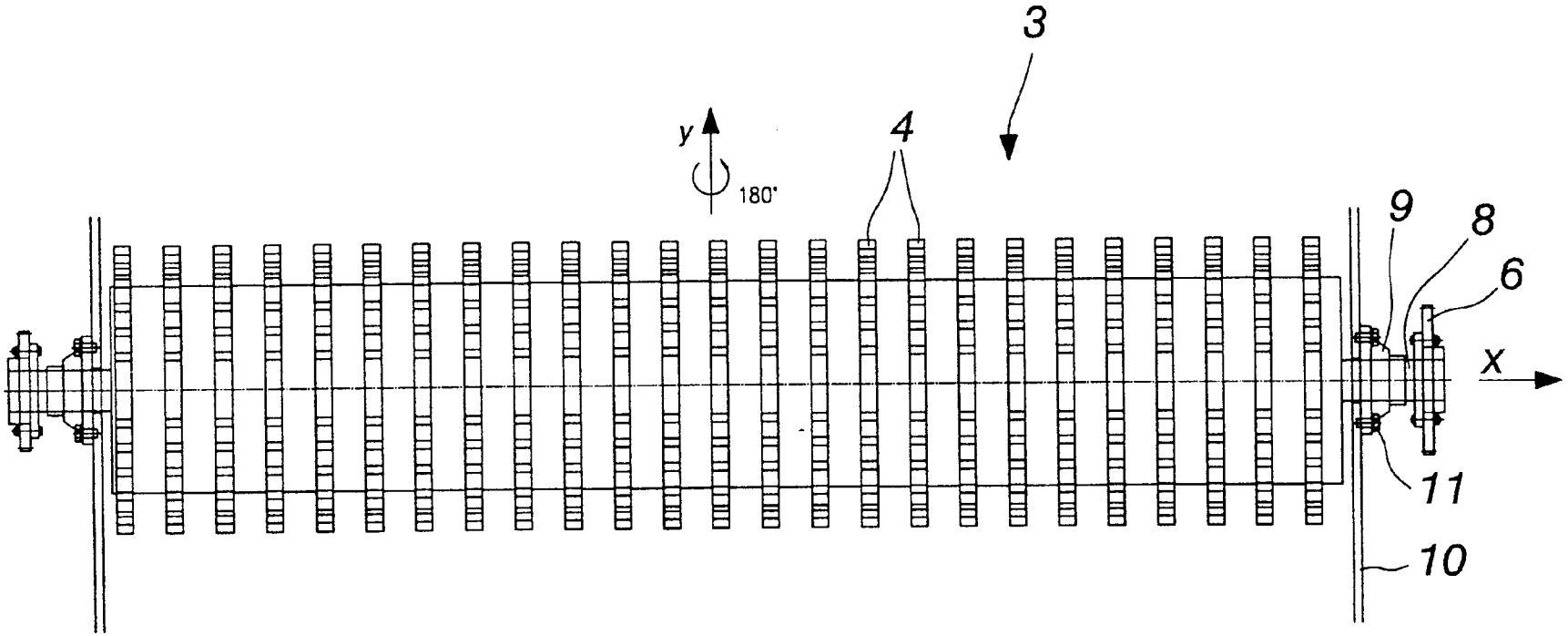
FIG. 3 is a side view of one mounted debarking shaft as shown in FIG. 2 taken along line III—III thereof.

The teeth 4 carried by the debarking shafts 3 are designed to be effective in both rotating directions of the debarking shafts 3. However, in the debarking machine 1, the debarking shafts 3 are all rotating always in the same direction as indicated by an arrow 7 (FIG. 2). The teeth 4 can nevertheless be exploited in both rotational directions when the debarking shafts 3 are designed to be reversible. In the configuration of FIG. 1, all four debarking shafts 3 are designed to be identical to each other. However, the teeth, set at regular spaces along the circumference of the debarking shaft 3, are positioned asymmetrically in the lengthwise direction of the shaft 3. An intermeshing for the teeth 4 of the adjacent shafts 3 is accomplished by installing the adjacent shafts 3 in opposite directions, i.e. reversed by 180°.

Figure 4:
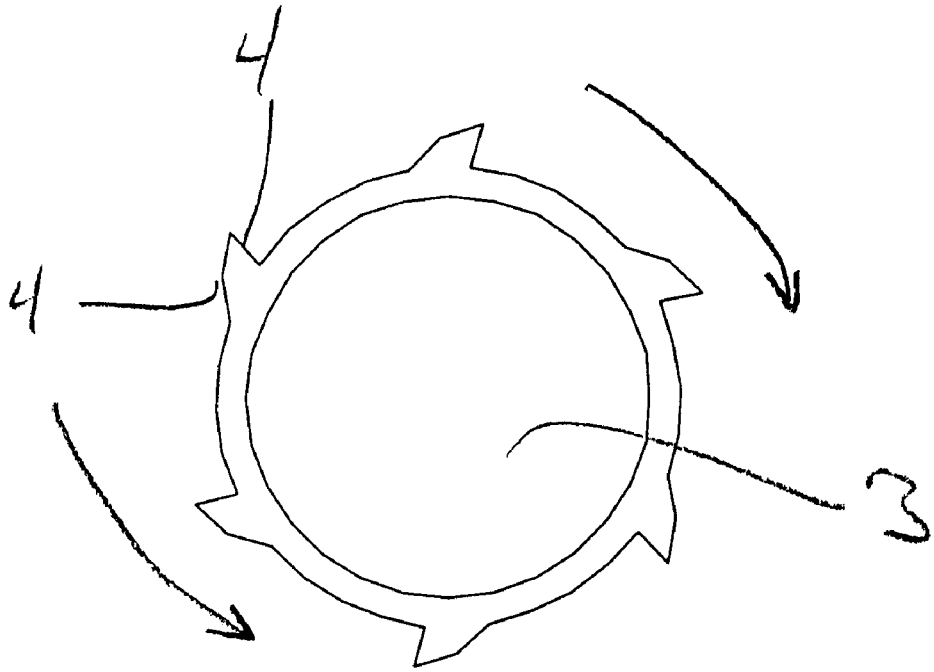
FIG. 4 is an end view of a shaft with teeth having a different configuration for opposite rotational directions of the shaft.

The teeth 4 effective in opposite rotating directions of the debarking shaft 3 can be different from or similar to each other. This arrangement enables a speedy deployment of new teeth just by pivoting and securing a shaft at 180° relative to the original position, whereby it is parallel to the original position but has an opposite rotating direction with respect to the original position. For example, the topmost shaft in FIG. 1 in a reversed condition can be substituted either for the shaft second from top or for the lowermost shaft. FIG. 4 illustrates a shaft having teeth 4 with very different configurations corresponding to opposite rotational directions of the shaft 3.

The debarking shafts 3 have each end thereof provided with smaller-diameter shaft stubs 8, on which are mounted bearings, along with bearing cups 9 therefor, as well as the sprockets 6. The bearing cups 9 are adapted to be secured with screws 11 to end panels 10 present at the ends of the debarking machine 1 in line with the debarking shafts 3.

In accordance with one preferred embodiment of the invention, each debarking shaft 3 has its attachment to the debarking machine 1 implemented in such a way that the shaft 3, during removal, may be lifted from its position and, respectively, in the process of installation, settable into its position through a wood treating space 5 present in the debarking machine 1. In the illustrated example, this is implemented in such a way that the end panels 10 have a top edge thereof provided with open-topped grooves or slots 12 for the shaft stubs 8 of the debarking shafts 3.

While a preferred embodiment of the foregoing invention has been set forth for the purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. An improved debarking shaft arrangement for a debarking machine, intended for the decortication or pretreatment of logs before a separately performed final barking and for the expulsion of at least some of the removed barks from a wood flow passing through the debarking machine, said debarking machine comprising a number of rotatable debarking shafts having opposed ends, said shafts extending parallel to the advancing direction of the logs to be fed therethrough and provided with a number of teeth extending beyond circumferential surface of the shaft and adapted to strip bark off the logs transversely to the lengthwise direction of the logs and at the same to convey the logs transversely relative to said shafts, said shafts supported for rotation by bearings adjacent each end and provided with rotational energy through a sprocket fixed to the shaft, said shafts, together with the teeth thereof, being adapted to constitute at least a part of a support surface, upon which the logs travel through the debarking machine, wherein the improvement comprises the teeth are configured to remove bark from the logs in both rotating directions of said rotatable debarking shafts, and both ends of the debarking shafts carry a sprocket.

2. An improved arrangement as set forth in claim 1, wherein the teeth effective in opposite rotating directions of the debarking shaft are different from each other.

3. An improved arrangement as set forth in claim 1, wherein the teeth effective in opposite rotating directions of the debarking shaft are substantially identical to each other.

4. An improved arrangement as set forth in claim 1, wherein the debarking shaft is designed and dimensioned in such a way that a removed debarking shaft, after being pivoted through 180°, is mountable in a position from which it was removed or in place of another debarking shaft.

5. An improved arrangement as set forth in claim 1, wherein the debarking shaft is designed and dimensioned in such a way that a removed debarking shaft, after being pivoted through 180°, is mountable in a position adjacent to a position from which it was removed.

6. An improved arrangement as set forth in claim 1, comprising end panels at least partially defining a wood treating space therebetween, said bearings mounting to said end panels, wherein said end panels define open ended slots, whereby the debarking shafts are liftable from a mounted position and, settable into the mounted position through the wood treating space.

7. A debarking machine for the preliminary debarking of logs having a length and proceeding through the debarking machine with their length parallel to a process direction, said debarking machine comprising:

a plurality of rotatable debarking shafts having substantially identical opposite longitudinal ends equipped with a bearing and sprocket so that each shaft is mountable in either of two orientations parallel to said process direction; and a plurality of teeth mounted to each said debarking shaft to radially project from the shaft, each said tooth configured to remove bark from logs transversely to the length of the logs regardless of the rotational direction of the debarking shaft to which the teeth are mounted.

8. The debarking machine of claim 7, wherein each tooth has a working face effective in a first rotational direction of the debarking shaft to which the tooth is mounted and a second working face effective in a second rotational direction of the debarking shaft to which the tooth is mounted and said first and second working faces are different from each other.

9. The debarking machine of claim 7, wherein each tooth has a working face effective in a first rotational direction of the debarking shaft to which the tooth is mounted and a second working face effective in a second rotational direction of the debarking shaft to which the tooth is mounted and said first and second working faces are substantially identical to each other.

10. The debarking machine of claim 7, wherein said two orientations are achieved by rotating the shaft 180° such that the positions of a first and a second of said opposite longitudinal ends of the shaft relative to the debarking machine are reversed.

11. The debarking machine of claim 7, wherein groups of teeth are mounted to each shaft at regular axial intervals along each debarking shaft to form a pattern of teeth, said pattern being positioned asymmetrically relative to the length of each debarking shaft such that intermeshing of the teeth of adjacent debarking shafts is accomplished by installing the shafts in alternating orientations relative to said debarking machine.

12. The debarking machine of claim 7, wherein said debarking shafts are mounted to the debarking machine such that each debarking shaft may be lifted from its position and lowered into its position through a wood treating space of the debarking machine.

13. The debarking machine of claim 7, wherein each said shaft comprises drive transmission means for transmitting rotational energy to the shaft, said drive transmission means being mounted to both ends of said shaft.

14. The debarking machine of claim 13, wherein said drive transmission means comprise a sprocket.

* * * * *